United States Patent [19]

Hasegawa

[11] Patent Number: 4,543,046

[45] Date of Patent: Sep. 24, 1985

[54] ROTARY COMPRESSOR

[75] Inventor: Masumi Hasegawa, Fuji, Japan

[73] Assignee: Tokyo Shibaura Denki Kabushiki Kaisha, Kawasaki, Japan

[21] Appl. No.: 181,857

[22] Filed: Aug. 27, 1980

[30] Foreign Application Priority Data

Aug. 27, 1979 [JP] Japan ..... 54-108821

[51] Int. Cl.[4] ..... F04C 18/00; F04C 29/02; F04B 39/02; F04B 23/04

[52] U.S. Cl. ..... 418/63; 418/87; 418/88; 417/76; 417/87; 417/151; 417/368; 417/410; 417/902; 417/557; 184/6.16

[58] Field of Search ..... 418/83, 87, 88, 96, 418/98, 63, 65, 93, 125, 129, 249; 417/87, 151, 240, 368, 372, 902

[56] References Cited

U.S. PATENT DOCUMENTS 3,023,708 3/1962 Thiele ..... 417/420

FOREIGN PATENT DOCUMENTS 2504344 10/1975 Fed. Rep. of Germany ..... 417/87

87512 7/1975 Japan ..... 418/88

*Primary Examiner*—Carlton R. Croyle
*Assistant Examiner*—Paul F. Neils
*Attorney, Agent, or Firm*—Oblon, Fisher, Spivak, McClelland & Maier

[57] ABSTRACT

A horizontal type rotary compressor includes a lubricant distribution system which does not require a check valve for preventing the return of lubricant from the frictional bearing surfaces to the blade chamber. An eccentric blade within a blade chamber pumps lubricant out of the blade chamber through an aperture in one wall thereof. A dispensing pipe communicates the aperture of the blade chamber with the frictional bearing surfaces and includes an opening in the pipe adjacent the blade chamber. Reciprocal movement of the blade causes lubricant to be sucked through the aperture of the blade chamber and discharged from the blade chamber into the dispensing pipe. The opening in the pipe permits a larger amount of lubricant to pass into the pipe than out of the pipe, thereby effectively acting as a check valve and negating the need for a separate check valve in the lubricant distribution system.

1 Claim, 6 Drawing Figures

ROTARY COMPRESSOR

BACKGROUND OF THE INVENTION

1. Field of the Invention

The present invention relates generally to a horizontal compressor and more particularly to a horizontal compressor which is provided with an improved lubricant distribution system resulting in a decreased frictional loss and an especially high performance.

2. Description of the Prior Art

A large variety of hermetic compressors are known and are in use for apparatuses such as air conditioners, refrigerators and so forth. One of the most widely employed types is known as a horizontal hermetic compressor. Because these hermetic compressors include a rotational element they need lubrication designed to reduce frictional loss and to increase efficiency.

In a horizontal hermetic compressor in which a rotational element is horizontally disposed, machine lubricant will be stored in a lower half of the hermetic enclosure. To avoid disturbing the rotational movement of the rotor the level of lubricant needs be low enough so as not to reach the lowest portion of the rotor. But since the rotational axis of the rotor requires much lubrication the lubricant must be pumped up thereto.

A reciprocating blade has been used in the prior art for the purpose of feeding the rotational shaft with ample lubricant, theretofore, reciprocating movement of the blade has been known. For example, as shown in Japanese Patent Disclosure 54-31918, a lubricant dispensing pipe has been provided at the lower part of the bearings to connect the blade chamber with the motor shaft. In accordance with the reciprocal movement of the blade, lubricant flows in through the lubricant distribution pipe, thus distributing lubricant up to the motor shaft.

This type of horizontal compressor, however, must be supplied with a check valve so that the lubricant does not return to the blade chamber. The valve mechanism for this type of compressor tends to be complicated and often subject to mechanical troubles.

SUMMARY OF THE INVENTION

The horizontal compressor with an improved lubricant distribution system according to this invention includes a motor part having a stator, a rotor and a rotational shaft connected therewith, a compressor part having a cylinder, a roller, a pair of bearings, and a blade accommodated in the cylinder and moving in a reciprocal manner as the roller revolves around the eccentric portion of the rotational shaft. The pair of bearings and the blade constitute a blade chamber which operates as a reservoir from which lubricant is to be pumped out. A dispensing pipe is provided to communicate the lubricant chamber with the metal to metal contacting surfaces between the rotating shaft, the roller and the surfaces at which frictional loss may generate, thereby decreasing frictional loss and increasing efficiency.

It is a primary object of the present invention to provide an improved, simple, efficient system of lubricant distribution for a horizontal compressor.

Another object of this invention is to provide a lubricant distribution system for a horizontal compressor without the need for a check valve to avoid reverse flow.

Still another object of this invention is to present a lubricant distribution system for a horizontal compressor with a lubricant dispensing pipe which has an opening near one end thereof in communication with lubricant reservoir outside the blade chamber, the opening functioning both as a check valve and as a lubricant escape outlet.

Still a further object of this invention is to provide a lubricant distribution system for a horizontal compressor with a lubricant dispensing pipe having one end connected with a sliding surface of the rotational shaft and another end open in a spaced relationship with the lubricant discharge port in the lubricant reservoir.

BRIEF DESCRIPTION OF THE DRAWINGS

Various other objects, features and attendant advantages of the present invention will be more fully appreciated as the same becomes better understood from the following detailed description when considered in connection with the accompanying drawing in which like reference characters designate like or corresponding parts throughout the several views, and wherein.

DETAILED DESCRIPTION OF THE PREFERRED EMBODIMENTS

Figure 1:
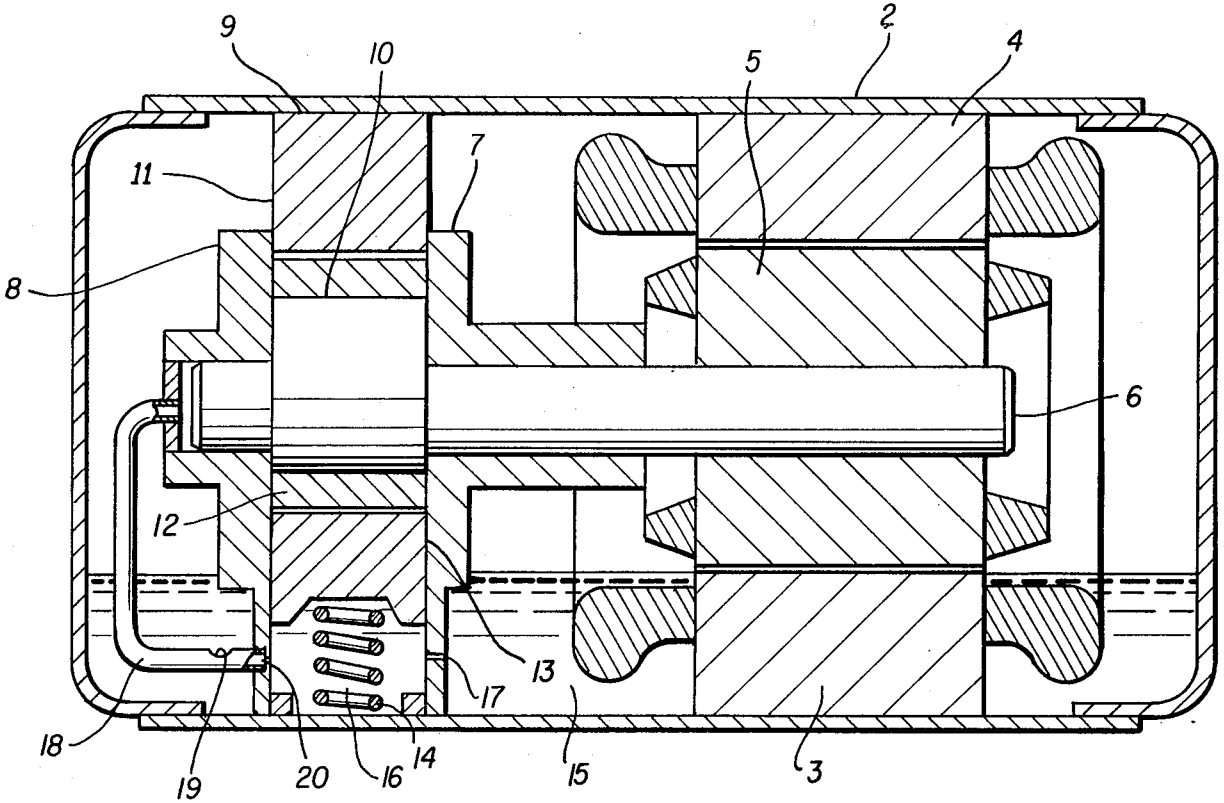
FIG. 1 is an exploded elevational view of a horizontal type rotary compressor with the improved lubricant supplying system of this invention.

In the embodiment depicted in the drawings, it will be noted that a horizontal compressor has been selected to illustrate a preferred application of the invention.

Referring now to FIG. 1, an illustrated horizontal type compressor 1 has a hermetic shell 2 which contains compressor elements. To the right of the compressor 1 is disposed a motor part 3 consisting of a stator 4 fixed to the inner wall of the hermetic shell 2, a rotor 5 provided in a concentric and spaced relationship with the stator 4 and which rotates inside the stator 4. In the center of the rotor 5 is force fit a motor shaft 6 rotatably connected with the rotor 5 and which extends to the left half of the horizontal hermetic shell 2 and is supported at the left end thereof by a pair of bearings 7, 8.

Turning to the left half of the compressor 1, there is located a compressor part 9. The compressor part 9 comprises the left half of the rotational shaft 6 which is provided with an integrally-formed eccentric portion 10, the pair of bearings 7, 8 supporting both ends of the eccentric portion 10. There is also provided between the bearings 7, 8 a cylinder 11 for accommodating the eccentric portion 10. The eccentric portion 10 is surrounded by a roller 12, roller 12 being an annular member which is to revolve around the eccentric portion 10 in a conventional manner.

The cylinder 11 is also provided with a blade 13 which is urged upward by a spring member 14. The blade 13 is in continuous contact with the roller 12 and moves upward and downward in accordance with the movement of the eccentric portion 10.

The cylinder 11, the roller 12 and the bearings 7 and 8 define a compression chamber. The compression chamber is divided by the blade 13 into a suction compartment to which refrigerant is introduced and a discharge compartment from which compressed refrigerant is discharged.

All the contacting surfaces between: the cylinder 11 and the roller 12, the roller 12 and the pair of bearings 7 and 8, the pair of bearings 7 and 8 and the shaft 6, the cylinder 11 and the blade 13 and so forth, require lubrication.

In an attempt to store lubricant for these bearing surfaces, the bottom half of the hermetic enclosure includes a lubricant reservoir 15. Lubricant is to be stored in this reservoir to the extent that its surface should be no higher than the lowest portion of the rotor 5 to avoid any possible disturbance of the rotational movement of the rotor 5.

A more detailed description will now be given with respect to the improved lubricant system.

The pair of bearings 7 and 8, the cylinder 11 and the blade 13 constitute a lubricant compartment 16. A suction aperture 17 is provided on the right bearing 7 to allow the lubricant to flow into the compartment 16, while a discharge aperture 20 is bored in the left bearing 8 to let lubricant discharge therethrough.

The bearing 8 is also provided with a lubricant dispensing pipe 18 having one end connected to the lubricant compartment 16 through the discharge aperture 20 and the other end communicated with the rotational shaft and with the aforementioned contacting surfaces.

Near the one end of the lubricant dispensing pipe 18 is provided an opening 19 which is in communication with the external lubricant reservoir 15.

Figure 2:
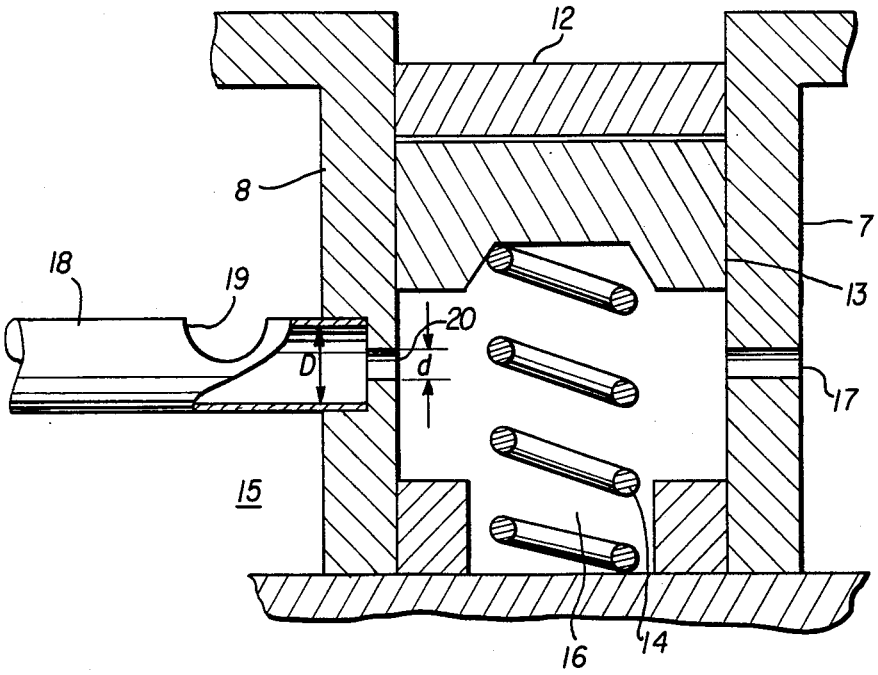
FIG. 2 is an enlarged and exploded partial view of the horizontal type rotary compressor having a lubricant dispensing pipe with the opening of the FIG. 1.

Referring now to FIG. 2, there is shown an enlarged and exploded sectional view of the lubricant compartment 16 and the one end of the lubricant dispensing pipe 18.

The lubricant dispensing pipe 18 is to be forcefit into the wall of the bearing 8. The bearing 8 is provided with a discharge opening 20 which is communicated with the end opening of the lubricant distribution pipe 18. The lubricant distribution pipe 18 further has a round opening 19 on the upper half near the open end thereof.

Figure 3:
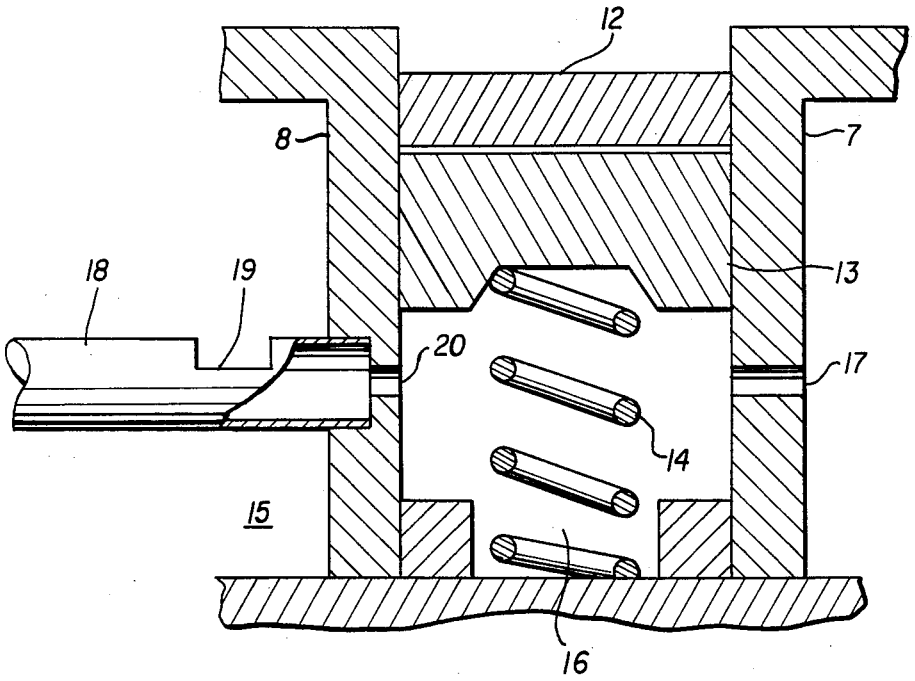
FIGS. 3, 4, 5 and 6 are enlarged and exploded views of various embodiments of the horizontal type rotary compressor of this invention.
Figure 4:
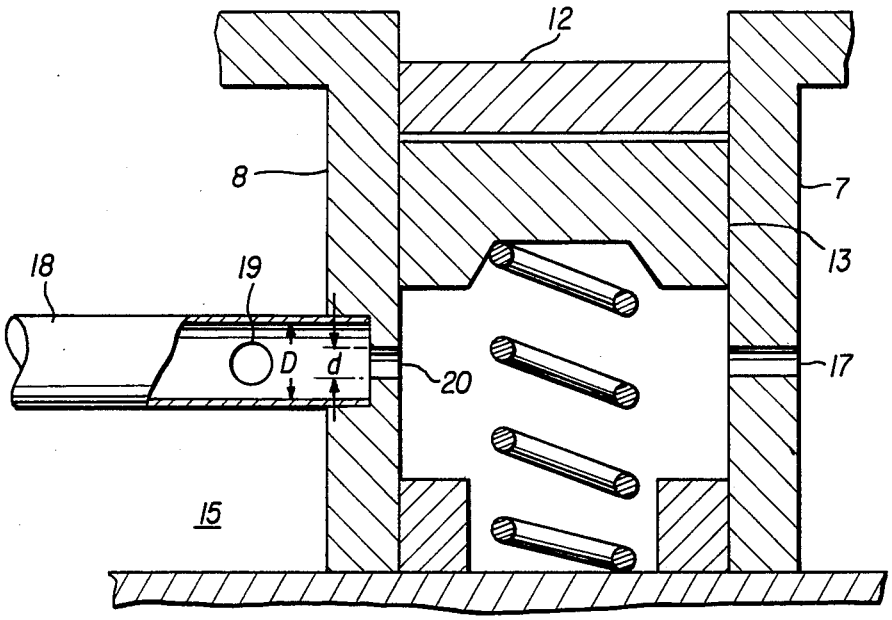

As illustrated in FIGS. 3, 4, 5 and 6 the forms of the opening may be varied. The form may, for example, be changed into one as shown in FIG. 3; or the lubricant distribution pipe 18 may be bored from one side through the other as seen in FIG. 4.

Figure 5:
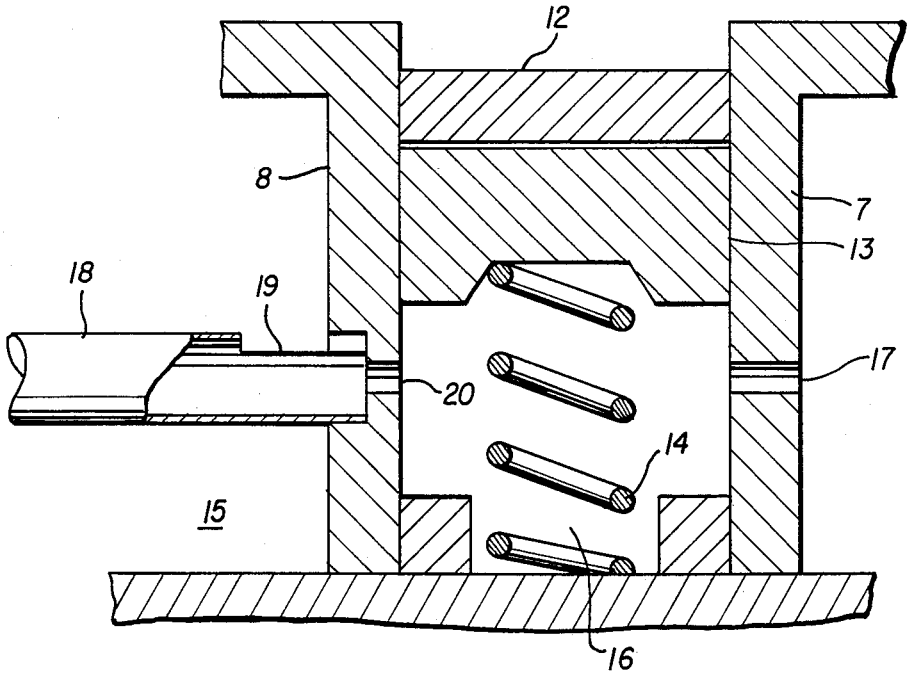

FIG. 5 shows another embodiment in which the end of the lubrication pipe 18 may be partially cut.

Figure 6:
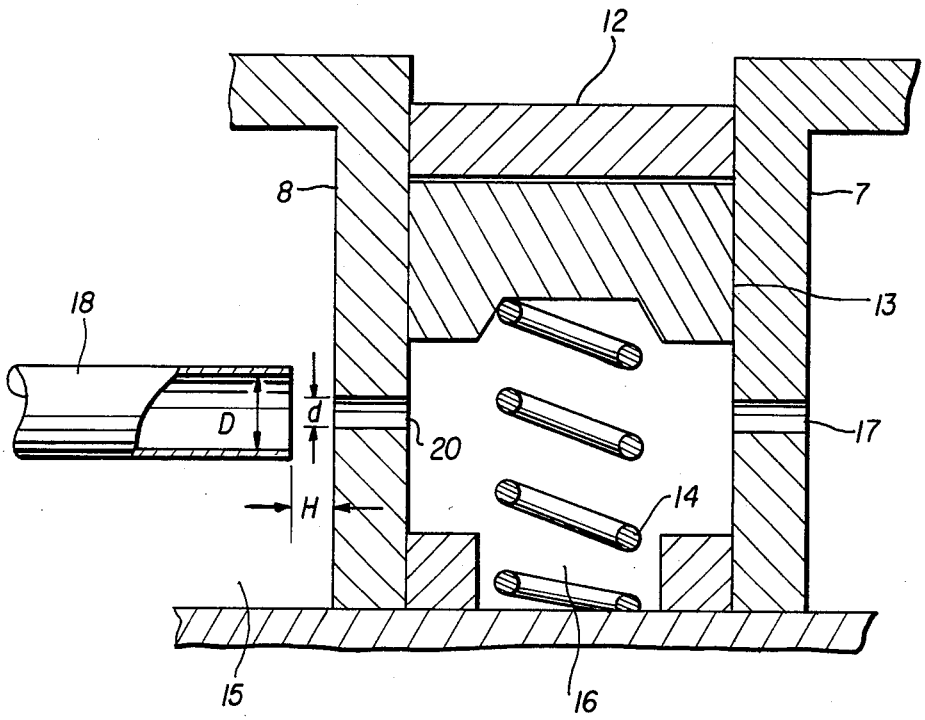

In an extreme case as shown in FIG. 6, the end of the lubricant distribution pipe 18 may be spaced apart from the bearing 8. But in this case the pipe end should properly face the discharge opening 20.

Then there will now be explained, using the Figures, the operation of the present invention. Due to the rotational movement of the shaft 6 the eccentric portion 10 and the roller 12 begin rotating. In accordance with the eccentric rotation of the roller 12 the blade 13 reciprocates in a known manner.

As the blade 13 ascends, lubricant primarily flows into the lubricant chamber 16 through the suction aperture 17. When the blade 13 descends, lubricant primarily flows out from the chamber 16 through the discharge aperture 20, into the lubricant distribution pipe 18, and into where the metal to metal contacts exist.

It was found that when the blade 13 moves downwards and lubricant is pumped up through the lubricant distribution pipe 18 there are relatively small amounts of lubricant leakage through the opening 19; conversely, when the blade 13 is on its way up and lubricant tends to return to the chamber 16, there will be a comparatively large amount of lubricant flow through the opening 19. This may be partly attributable to the existing difference in the flow resistances between the opening 19 and the discharge aperture 20.

Accordingly, the opening 19 functions as a check valve, thus eliminating the necessity of employing any valve means.

The relationship in the embodiment of FIG. 2 between the dimensions of the diameter d of the discharge aperture 20 and the inner diameter D of the lubricant dispensing pipe 18 is such that $D/d=1.5$, but this cannot always be applied to other embodiments.

The inner diameter D of the lubricant distribution pipe 18 should be at least as large as the diameter of the discharge aperture 20 so as to maintain a minimum initial velocity of lubricant to force the lubricant up through the lubricant pipe 18.

At the same time the opening 19 formed on the lubricant pipe 18 should be substantially large enough to let lubricant enter therethrough during the reverse lubricant flow, and to induce lubricant therethrough during the normal pumping up flow.

In the case of the embodiment of FIG. 6, the lubricant distribution pipe 18 can be completely separated from the bearing 8.

The distance H between the lubricant pipe 18 and the bearing 8 should be kept appropriate to maintain the escape and induction operation for the lubricant. For this purpose the lubricant pipe 18 is desirably supported by a supporting member.

EXAMPLE 1

As a result of an experiment on the embodiment illustrated in FIG. 4, in which there was employed a lubricant distribution pipe 18 with an inner diameter $D=3$ mm, with two round openings having a diameter of 2.4 mm, and bearing 8 with a discharge aperture 20 which had a diameter of 2 mm, the lubricant supplying capacity reached about 400 cc/min.

EXAMPLE 2

Another experiment taught that in the embodiment in FIG. 6 with $D=3$ mm, $d=2$ mm, and H-3 mm, the capacity of distribution of the lubricant amounted to about 200 cc/min.

It is known to a person skilled in the art that for the purpose of lubricating the mechanical elements of a compressor the circulating quantity of lubricant should be no smaller than 100 cc/min. Accordingly it should be understood that the dispensing capacity of 200 cc/min. reached by the above experiment more than satisfies the minimum desired level for machine lubrication.

The distance H in the embodiment shown in FIG. 6 should not be determined in isolation, but should be determined depending on the relationships among the individual dimensions of D, d and other factors. Generally speaking however, there is a tendency with relation to H that the lubricant dispensing capacity increases as H increases from zero to a peak, and then begins decreasing as H further increases.

Similar relationships can be obtained between the radial separation of the centers of the discharge aperture 20 and the lubricant dispensing pipe 18. When they are in or near a coaxial relationship the lubricant dispensing capacity peaks at a maximum value and as the distance between the two centers increases the capacity decreases.

It will be found that because of the self-generated oscillation of the motor, the center of the free-end of the lubricant pipe 18 may be subject to deviation so that it needs be fixed to any nearby part available.

Although particular embodiments are disclosed above, it is not intended that the scope of the application be limited to those embodiments, as other modifications would be obvious to one of ordinary skill in the art upon reading this application. Thus various forms of lubricant pipe and an opening for inducing and escaping lubricant can be substituted for a particular embodiment depicted hereinabove without departing from the spirit of this invention.

What is claimed as new and desired to be secured by Letters Patent of the United States is:

1. A horizontal type rotary compressor comprising:

a hermetic casing with bottom portion thereof defining a lubricant reservoir;

a motor part comprising a stator fixedly disposed on the inner wall of said hermetic casing;

a rotor rotatably arranged in a spaced and concentric relationship with said stator, and a rotational shaft connected with said rotor and extending horizontally along said hermetic casing;

a compressor part connected to said motor part by means of said rotational shaft and comprising an eccentric member integrally formed with said rotational shaft at the opposite end from said motor, bearing members provided at both sides of said eccentric member for supporting the rotational movement of said shaft, said bearing members having a suction aperture and a discharge aperture in communication with said lubricant reservoir for allowing lubricant to pass therethrough, said discharge aperture having a first diameter, an annular member concentrically and rotatably surrounding said eccentric member and placed between said bearing members, a cylinder for defining a compression chamber together with said annular member and said set of bearing members, a blade extending radially through said cylinder, having one end in contact with said annular member and another end urged by a spring member, said blade dividing said compression chamber into a high pressure compartment and a low pressure compartment; and a pipe member having a second internal diameter larger than said first diameter, said pipe member further having one end in communication with said discharge aperture of one of said bearing members, but being spaced therefrom to define an opening therebetween, and another end in communication with a lubricant path leading to where machine contacts exist, wherein said blade and said bearings define a blade chamber whereby said blade due to the reciprocal movement thereof sucks lubricant through said suction aperture into said blade chamber and discharges lubricant from said blade chamber through said discharge aperture into said lubricant pipe member and as lubricant passes through said opening it induces ambient lubricant into said pipe thereby supplying lubricant to said lubricant path while substantially prohibiting the reverse flow of lubricant back into said blade chamber.

* * * * *